US006073610A

United States Patent [19]

Matsumoto et al.

[11] Patent Number: 6,073,610

[45] Date of Patent: Jun. 13, 2000

[54] CONTROL APPARATUS OF INTERNAL COMBUSTION ENGINE EQUIPPED WITH ELECTRONIC THROTTLE CONTROL DEVICE

[75] Inventors: Takuya Matsumoto, Okazaki; Toru Hashimoto, Toyoake; Mitsuhiro Miyake, Kyoto; Seiichi Inoue, Okazaki, all of Japan

[73] Assignee: Mitsubishi Jidosha Kogyo Kabushiki, Japan

[21] Appl. No.: 09/070,096

[22] Filed: Apr. 27, 1998

[30] Foreign Application Priority Data

Apr. 25, 1997 [JP] Japan ..... 9-123434

[51] Int. Cl.[7] ..... F02D 41/22; F02D 43/00

[52] U.S. Cl. ..... 123/396; 123/399; 123/479

[58] Field of Search ..... 123/396, 361, 123/399, 295, 397, 479

[56] References Cited

U.S. PATENT DOCUMENTS

| | | | |
|---|---|---|---|
| 5,339,782 | 8/1994 | Golzer et al. | 123/399 |
| 5,553,581 | 9/1996 | Hirabayshi et al. | 123/399 |
| 5,601,063 | 2/1997 | Ohashi et al. | 123/396 |
| 5,602,732 | 2/1997 | Nichols et al. | 123/361 |
| 5,823,164 | 10/1998 | Seki et al. | 123/399 |

*Primary Examiner*—Willis R. Wolfe
*Assistant Examiner*—Hieu T. Vo
*Attorney, Agent, or Firm*—Rossi & Associates

[57] ABSTRACT

In an internal combustion engine equipped with an electronic throttle control device for electrically driving a throttle valve, a control apparatus includes failure detecting means for detecting a failure of the electronic throttle control device, and control means for limiting fuel supply to the engine when the failure detecting means detects a failure of the electronic throttle control device, if the rotating speed of the engine becomes equal to or higher than a predetermined value.

26 Claims, 5 Drawing Sheets

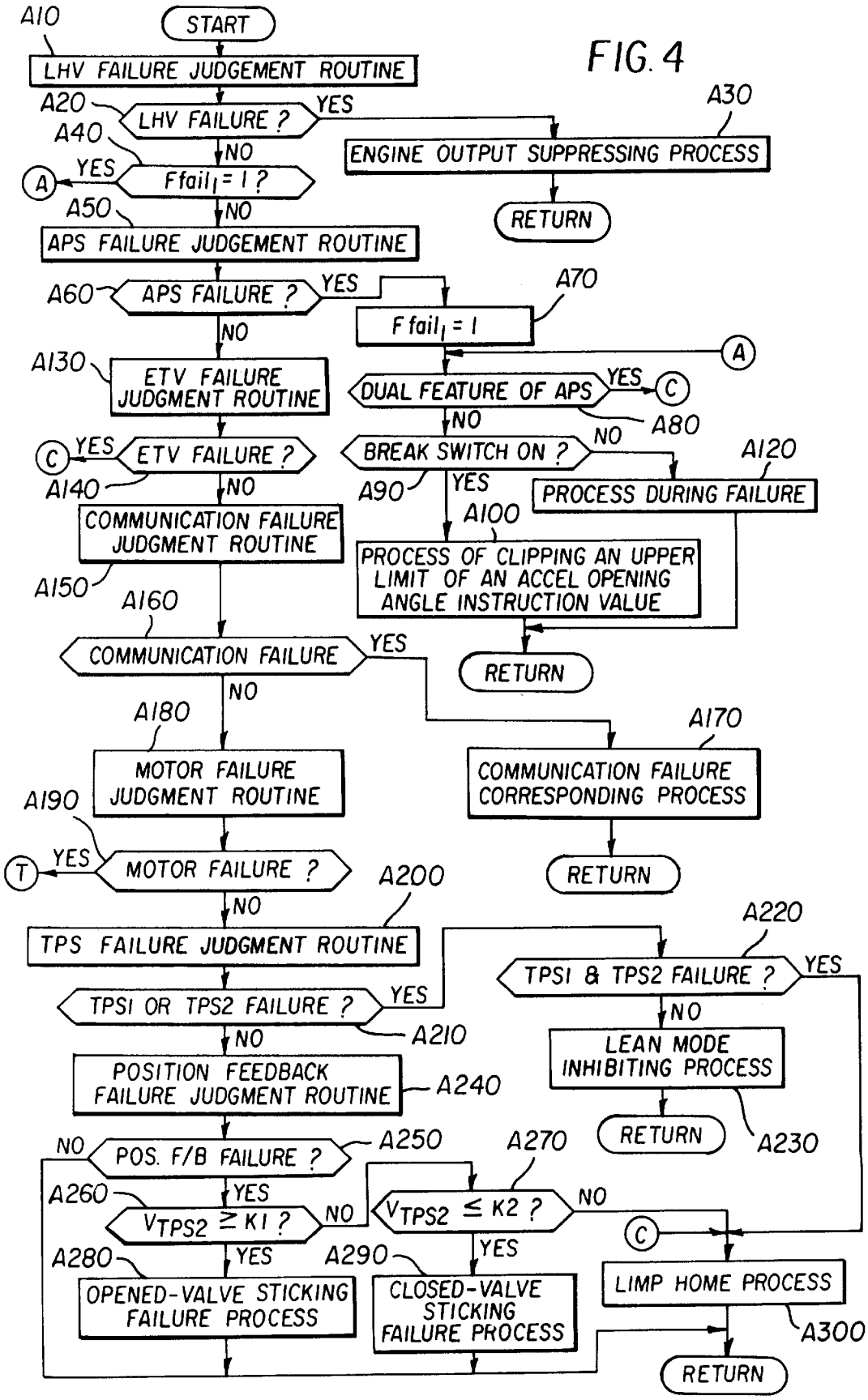
FIG. 4
START
A10
LHV FAILURE JUDGEMENT ROUTINE
A20
LHV FAILURE ?
YES
A30
ENGINE OUTPUT SUPPRESSING PROCESS
RETURN
NO
A40
Ffail1 = 1 ?
YES
A
NO
A50
APS FAILURE JUDGEMENT ROUTINE
A60
APS FAILURE ?
YES
A70
F fail1 = 1
NO
A130
ETV FAILURE JUDGMENT ROUTINE
A
DUAL FEATURE OF APS
YES
C
A80
NO
C
YES
ETV FAILURE ?
A140
NO
BREAK SWITCH ON ?
NO
A120
A90
YES
PROCESS DURING FAILURE
COMMUNICATION FAILURE JUDGMENT ROUTINE
A100
PROCESS OF CLIPPING AN UPPER LIMIT OF AN ACCEL OPENING ANGLE INSTRUCTION VALUE
A150
A160
COMMUNICATION FAILURE
YES
RETURN
NO
A180
A170
MOTOR FAILURE JUDGMENT ROUTINE
COMMUNICATION FAILURE CORRESPONDING PROCESS
A190
T
YES
MOTOR FAILURE ?
A200
RETURN
NO
A220
TPS FAILURE JUDGMENT ROUTINE
TPS1 & TPS2 FAILURE ?
YES
TPS1 OR TPS2 FAILURE ?
YES
NO
A210
LEAN MODE INHIBITING PROCESS
NO
POSITION FEEDBACK FAILURE JUDGMENT ROUTINE
A240
RETURN
A230
NO
POS. F/B FAILURE ?
A250
A270
A260
YES
VTPS2 ≥ K1 ?
NO
VTPS2 ≤ K2 ?
NO
C
A280
YES
A290
YES
LIMP HOME PROCESS
OPENED-VALVE STICKING FAILURE PROCESS
CLOSED-VALVE STICKING FAILURE PROCESS
A300
RETURN

CONTROL APPARATUS OF INTERNAL COMBUSTION ENGINE EQUIPPED WITH ELECTRONIC THROTTLE CONTROL DEVICE

FIELD OF THE INVENTION

The present invention relates to a control apparatus of an internal combustion engine equipped with an electronic throttle control device, which apparatus is favorably used in an engine of a motor vehicle, and is provided with functions to control the engine in the event of a failure of the electronic throttle control device.

BACKGROUND OF THE INVENTION

For use in an engine of an automobile, for example, a drive-by-wire system (hereinafter referred to as "DBW") has been developed which is used for transmitting electric signals between an accelerator pedal and a throttle valve of the engine. In this DBW system, the accelerator pedal and the throttle valve are not mechanically connected to each other, and a virtual accelerator position (pseudo accelerator position) is determined based on the actual amount of depression of the accelerator pedal (actual accelerator position) and various other parameters,. The DBW system is able to control the throttle valve according to the virtual (pseudo) accelerator position, and may also be called "electronic throttle control device".

During an idling operation of the vehicle in which the accelerator pedal is not depressed (namely, the amount of depression of the accelerator pedal is lower than an infinitesimal value), for example, the DBW system is able to control the idle speed by finely adjusting the opening of the throttle valve. Also, the DBW system is able to set the pseudo accelerator position by correcting the actual accelerator position (the amount of depression of the pedal by the driver) according to the running state of the vehicle or operating state of the engine, and control the throttle valve based on this pseudo accelerator position, thereby to achieve an engine operation that gives the driver a good driving feeling.

As one type of internal combustion engines (generally, gasoline engines) using spark plugs for enabling spark ignition, in-cylinder fuel injection type spark ignition engines (hereinafter simply called "engine") in which a fuel is directly injected into each cylinder have been put in practical use. In this type of engine, the timing of fuel injection can be freely selected as desired, and the composition (air-fuel ratio) of an air-fuel mixture formed in a combustion chamber can be freely controlled. These advantageous features contribute to improvements in both of the fuel cost performance and output performance.

The in-cylinder fuel injection type spark ignition engine may operate in a first lean-burn mode (compression stroke injection mode) as one of combustion modes, in which the fuel is injected during a compression stroke, so that a fuel-lean, air-rich mixture (whose air fuel ratio is considerably larger than the stoichiometric ratio) undergoes startified charge combustion, to thus achieve an extreme lean-burn operation, assuring a significantly improved specific fuel consumption.

Needless to say, the in-cylinder fuel injection type spark ignition engine is also able to inject the fuel into a cylinder mainly during a suction or intake stroke, and burn an air-fuel mixture that has been mixed together before combustion. In this case, the fuel is directly injected into a combustion chamber within a cylinder, whereby most of the fuel injected in each combustion cycle can be surely burned in the same combustion cycle, to thus provide an improved engine output.

The above-described combustion operation with the premixed fuel and air may be performed in one of combustion modes: 1) a second lean-burn mode in which the engine operates with a fuel-lean, air-rich mixture (whose air fuel ratio is larger than the stoichiometric ratio) though the mixture contains a smaller percentage of intake air than that formed in the first lean-burn mode, 2) stoichiometric operation mode (stoichiometric feedback operation mode) in which feedback control is performed based on information from an $O_2$ sensor so that the air fuel ratio becomes substantially equal to the stoichiometric ratio, and 3) enrich operation mode (open-loop mode) in which the engine operates with a mixture having a high percentage of fuel (namely, a mixture whose air fuel ratio is smaller than the stoichiometric ratio).

Generally, if the required output of the engine is small, namely, if the engine speed is low and the load is small, the first lean-burn mode is established so as to reduce fuel consumption and improve fuel economy. As the engine speed and engine load increase, the operating mode of the engine is selected in the order of the second lean-burn mode, stoichiometric operation mode, and enrich operation mode.

When the engine operates in the extreme lean-burn mode (first lean-burn mode), an increased amount of air needs to be supplied to each combustion chamber so as to increase the air fuel ratio. In the first lean-burn mode, however, the engine operates in a region where the engine load is low, namely, the amount of depression of the accelerator pedal (difference between the current accelerator pedal position and its fully released position) is small, and therefore a desired air fuel ratio cannot be achieved if the opening of the throttle valve is controlled according to the amount of depression of the accelerator pedal.

A technique for dealing with the above problem has been developed, wherein an air bypass passage is provided which bypasses an intake passage having a throttle valve, and an electronic controlled valve (air bypass valve) is mounted in this air bypass passage. When the amount of intake air supplied to each combustion chamber is insufficient due to a small opening of the throttle valve controlled according to the accelerator position, the air bypass valve is opened depending upon a desired amount of intake air, so as to supply extra air into the combustion chamber.

SUMMARY OF THE INVENTION

In the meantime, the drive-by-wire (DBW) system as described above may be employed in the above in-cylinder fuel injection type spark ignition engine. Since the DBW system controls the opening of the throttle valve to a value that does not exactly corresponds to the accelerator position, a larger amount of air than that corresponding to the accelerator position can be supplied to each combustion chamber. Thus, when the in-cylinder injection type engine operates in a lean-burn mode (compression stroke injection mode), a desired amount of air can be supplied to each combustion chamber even if the accelerator pedal is depressed by a small amount.

When the above DBW system is employed, however, the in-cylinder type engine, or any other type of engine, should be provided with measures or devices to deal with a failure of the DBW.

For example, a failure of DBW may occur when the throttle valve controlled by DBW is stuck or fixed at a certain position because of foreign matters, such as dust, contained in exhaust gases recirculated by an exhaust gas recirculation system, or blow-by gas.

If the DBW system fails, the opening of the throttle valve cannot be appropriately controlled by the DBW system, thus making it difficult to produce an engine output that reflects the driver s intention or demand for the output. In other cases, the engine output may increase to be greater than required, thus causing the driver to apply brakes at a higher frequency so as to control the vehicle speed. This results in increased burdens on both the driver and the brake system.

The present invention has been developed in the light of the above situations. It is therefore an object of the present invention to provide a control apparatus of an internal combustion engine equipped with an electronic throttle control device, wherein the burden on the driver can be reduced during running of the vehicle when the electronic throttle control device fails.

BRIEF DESCRIPTION OF THE DRAWINGS

FIG. 4 is a flow chart showing fail-safe operations of the intake control system of the control apparatus of the engine equipped with the electronic throttle control device according to the embodiment of FIG. 1.

DETAILED DESCRIPTION OF THE PREFERRED EMBODIMENT

One preferred embodiment of the present invention will be described with reference to the drawings. FIG. 1 through FIG. 5 show a control apparatus of an internal combustion engine equipped with an electronic throttle control device according to one embodiment of the present invention.

The engine (internal combustion engine) constructed according to the present embodiment is an in-cylinder fuel injection type spark ignition engine (hereinafter simply called "in-cylinder injection engine"). The construction of the whole system of this engine will be described referring to FIG. 2.

Figure 2:
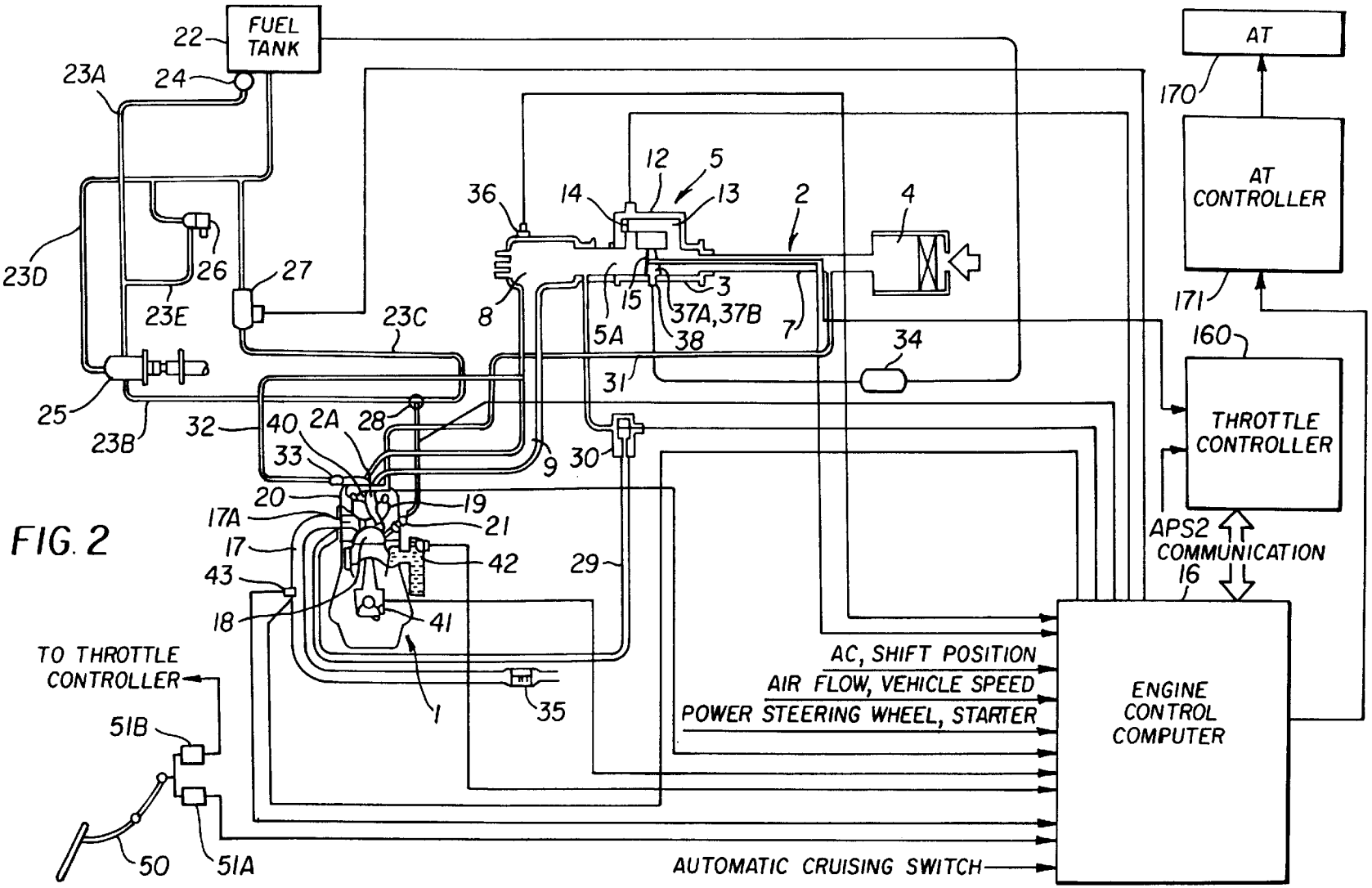
FIG. 2 is a block diagram showing the control apparatus of the engine equipped with the electronic throttle control device according to the embodiment of FIG. 1.

In FIG. 2, the engine system includes an engine body 1, intake passage 2, throttle valve installed portion 3, and an air cleaner 4. The intake passage 2 is connected to an intake pipe 7, throttle body 5, surge tank 8, and an intake manifold 9 in the order of description as viewed from the upstream side of the passage 2.

The throttle body 5 is provided with an electronic controlled throttle valve 15 which is electrically controlled, and the opening of this electronic controlled throttle valve 15 is controlled by means of a throttle control computer (throttle controller) 160 that will be described later. The target opening (target throttle opening) of the throttle valve 15 is determined by an engine control computer (engine ECU) 16 that will be described later, depending upon an amount of depression of an accelerator pedal 60 (accelerator pedal position) detected by an accelerator position sensor (APS1) 51A, and operating conditions of the engine.

Figure 1:
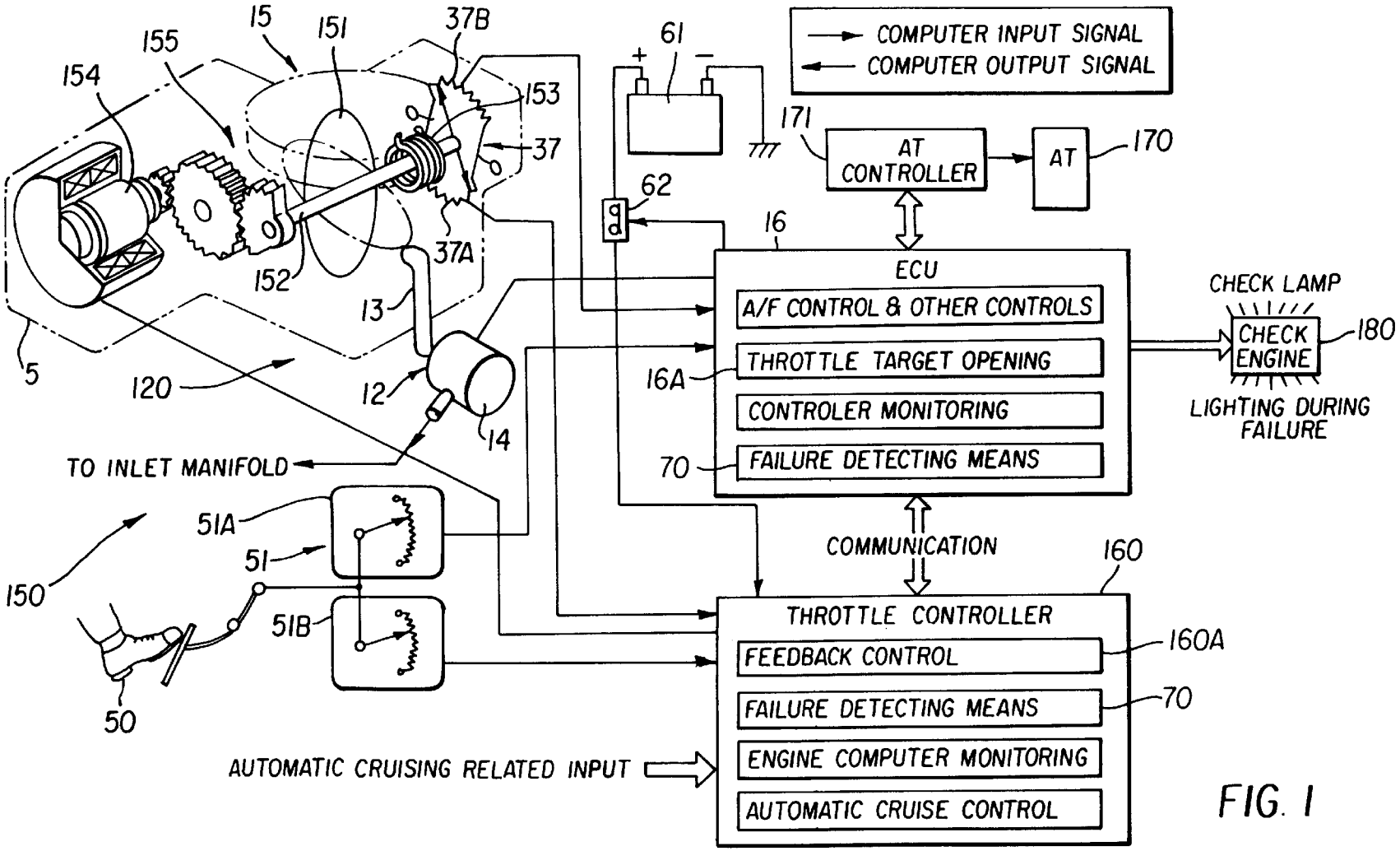
FIG. 1 is a schematic view showing a principal part of a control apparatus of an internal combustion engine equipped with an electronic throttle control device according to one embodiment of the present invention.

The electronic controlled throttle valve 15, engine ECU (control means) 16, throttle controller 160 and others constitute an electronic throttle control device (namely, drive-by-wire (DBW) 150 shown in FIG. 1).

In the engine system of FIG. 2, an air bypass valve device 12 is provided in parallel with the electronic control throttle valve 15. This air bypass valve device 12 serves to supply air so as to accomplish combustion in the engine while the electronic controlled throttle valve is at fault (for example, the valve is stuck at its closed position) as described later. The air bypass valve device 12 consists of a bypass passage 13 provided upstream of the surge tank 8 so as to bypass the electronic controlled throttle valve 15, and an air bypass valve body 14 mounted in this bypass passage 13. The air bypass valve body 14 is driven by a linear solenoid (not shown) that is controlled by the engine control computer (engine ECU) 16 which will be described later.

In FIG. 2, reference numeral 17 denotes an exhaust passage, and 18 denotes a combustion chamber. Intake valve 19 and exhaust valve 20 are respectively provided at openings (i.e., intake port 2A and exhaust port 17A) of the intake passage 2 and exhaust passage 17 which are open to the combustion chamber 18. Reference numeral 21 denotes a fuel injection valve (or injector). In the present embodiment, the injector 21 is adapted to directly inject a fuel into the corresponding combustion chamber 18.

The engine system of FIG. 2 further includes a fuel tank 22, fuel supply paths 23A–23E, low-pressure fuel pump 24, high-pressure fuel pump 25, low-pressure regulator 26, high-pressure regulator 27, and a delivery pipe 28. The fuel in the fuel tank 22 is driven by the lower-pressure fuel pump 24, and further pressurized by the high-pressure fuel pump 25, so that the fuel to which a certain high pressure is applied is supplied to the injector 21, through the fuel supply paths 23A, 23B and delivery pipe 28. During the supply of the fuel, the pressure of the fuel delivered from the lower-pressure fuel pump 24 is regulated by the lower-pressure regulator 26, and the pressure of the fuel delivered from the high-pressure fuel pump 25 is regulated by the high-pressure regulator 27.

The engine system of FIG. 2 further includes an exhaust gas recirculation passage (EGR passage) 29 through which apart of exhaust gases is recirculated into the intake passage 2, an EGR valve 30 for controlling the amount of exhaust gases recirculated through the EGR passage 29, a passage 32 through which blow-by gas is circulated, a valve 33 for positively ventilating a crank chamber, a canister 34, and a catalyst (three-way catalyst in this embodiment) used for exhaust emission control.

As shown in FIG. 2, the engine ECU 16 is adapted to control driving of the injector 21, and driving of an ignition coil for actuating a spark plug (not shown), and also control an opening angle of the EGR valve, pressure applied to the fuel by the high-pressure regulator 27, and so on. In addition, the engine ECU 16 controls the air bypass valve device 12 in accordance with operating conditions and failure states of the engine. The throttle controller 160 controls opening and closing of the electronic controlled throttle valve 15, according to an acceleration command by a driver, and operating conditions and failure states of the engine.

To perform the above functions, the engine ECU 16 receives signals representing results of detection, from the first accelerator position sensor (APS1) 51A, air flow sensor (not shown), intake temperature sensor 36, throttle position sensor (TPS) 37B for detecting the throttle opening, idle switch 38, air conditioner switch (not shown), shift position sensor (not shown), vehicle speed sensor (not shown), power steering switch (not shown) for detecting the operating state of a power steering system, starter switch (not shown), first cylinder detecting sensor 40, crank angle sensor 41, water temperature sensor 42 for detecting the temperature of cooling water of the engine, $O_2$ sensor 43 for detecting the oxygen concentration in exhaust gases, and so on. Since the rotating speed of the engine or engine speed is calculated based on a signal from the crank angle sensor 41, the crank angle sensor 41 may be called "engine speed sensor" for the sake of convenience.

The throttle controller 160 receives signals representing results of detection from the accelerator position sensor (APS) 51B, throttle position sensor (TPS) 37A, and others, as shown in FIG. 2.

The engine ECU 16 and throttle controller 160 are adapted to transmit and receive information to and from each other, through a suitable communication system.

The engine system of the present embodiment is further equipped with an automatic transmission controller (AT controller) 171 for controlling an automatic transmission 170. The engine ECU 16 and the AT controller 171 transmit and receive information to and from each other through a suitable communication system.

The engine system of the present embodiment is also provided with a cruise control function, and the throttle opening is controlled by the throttle controller 160, for example, depending upon input information associated with the cruise control.

The engine constructed as described above may be placed in one of the following operating modes, i.e., a first lean-burn mode (compression stroke injection mode), second lean-burn mode, stoichiometric feedback combustion mode, and an open-loop combustion mode. In operation, an appropriate one of these operating modes is selected depending upon operating conditions (namely, engine speed and engine load) of the engine, running conditions of the vehicle, and others.

When the engine is placed in the first lean-burn mode, the fuel is injected in a stage of a combustion cycle that is very close to the ignition timing, such as in the later period of a combustion stroke, so that the fuel is concentrated in the vicinity of the spark plug, to thus form a fuel rich mixture only around the spark plug while filling the whole combustion chamber with a lean mixture, thereby to accomplish startified charge combustion. Thus, the first lean-burn mode is an extreme lean-burn mode in which the engine can operate with a reduced amount of fuel consumed, while assuring high reliability with which the fuel is fired or ignited, and high stability with which the fuel is burned in the combustion chamber. In the present embodiment, the overall air fuel ratio of the mixture in this mode is set to a range of about 24 or more, and thus lean-burn with the leanest mixture can be realized. However, the overall air fuel ratio may be set to a lower range than that of the present embodiment (for example, the overall air fuel ratio may be in a range of about 23 or more), or a higher range than that of the present embodiment.

In the second lean-burn mode, which is also one type of lean-burn modes, the fuel is injected at an earlier time (mainly in a suction stroke) as compared with the first lean-burn mode, so that the fuel is mixed in advance with air, to provide a mixture which, as a whole, has a higher air fuel ratio than the stoichiometric ratio, and a certain amount of output can be obtained upon burning of this mixture, while assuring high reliability in firing the fuel, and high stability in burning the fuel. In this lean-burn mode, therefore, the engine can operate with excellent fuel economy. The overall air fuel ratio of the mixture in this second lean-burn mode is set to a range that is lower than about 24 and higher than the stoichiometric ratio.

In the stoichiometric feedback combustion mode, the air fuel ratio is maintained at the stoichiometric level, based on the output of the $O_2$ sensor, so that a sufficiently large engine output can be obtained with high efficiency. In this mode, the fuel injection is conducted during a suction stroke, so that the fuel is mixed with air before burning.

In the open-loop combustion mode, the air-fuel mixture is burned with its air fuel ratio controlled under open-loop control to be stoichiometric or rich, so as to produce a sufficiently large output during acceleration or starting of the vehicle, for example. In this mode, the fuel injection is conducted during a suction stroke, so that the fuel is mixed with air before burning.

While each of the above-described operating modes is selected by the engine ECU 16, depending upon the engine speed and engine load, the first lean-burn mode is normally selected when the engine rotates at a low speed with a low load, and this mode is successively switched to the second lean-burn mode and the stoichiometric combustion mode in this order as the engine speed or engine load increases. If the engine speed or engine load increases further, the operating mode of the engine is switched to the open-loop mode (enrich combustion mode).

After selecting one of the above operating modes, the engine ECU 16 performs various control operations, of which throttle opening control will be described in detail. In the first lean-burn mode in which the fuel is injected during a compression stroke to provide an extremely high air fuel ratio, the target opening (pseudo target opening) of the throttle valve is set to be significantly larger than a throttle opening that corresponds to the actual accelerator pedal position, so as to achieve the target air fuel ratio, since the mixture obtained with the throttle opening that exactly corresponds to the accelerator pedal position has an insufficient percentage of air. In the stoichiometric feedback combustion mode and open-loop combustion mode, too, the percentage of air in the air-fuel mixture may be insufficient if the mixture results from the throttle opening that corresponds to the accelerator pedal position. In such cases, the target opening (pseudo target opening) is set to be suitably larger than the throttle opening that corresponds to the accelerator pedal position, and the opening of the throttle valve is controlled based on the target opening thus determined.

Referring to FIG. 1, the constructions of the electronic throttle control device (DBW) 150 and a control system 120 for the air bypass valve device 12 (namely, air bypass valve control device) according to the present invention will be described in detail.

The electronic controlled throttle valve 15 that constitutes the DBW 150 includes a butterfly valve 150 that is disposed in the intake passage 5A of the throttle body 5, a return spring 153 fitted on a shaft 152 that supports the butterfly valve 151, for applying a bias force to the butterfly valve 150 toward its closed position, an electric motor (throttle actuator) 154 for rotating/driving the shaft 152, and a gear mechanism 155 interposed between the actuator 154 and the shaft 152.

The shaft 152 is provided with a throttle position sensor 37 for detecting the opening of the butterfly valve 151 (throttle valve opening), which sensor 37 consists of a first throttle position sensor (TPS1) 37A and a second throttle position sensor (TPS2) 37B. Thus, the control device of the present embodiment is provided with two throttle position sensors (TPS1, TPS2) 37A, 37B, to prepare for a failure of either of the throttle position sensors 37A, 37B.

The drive-by-wire system (DBW) 150 principally consists of the electronic controlled throttle valve 15 as described above, engine ECU 16 for setting the target opening of the electronic controlled throttle valve 15, and the throttle controller 160 that controls the operation of the actuator 154 based on the target opening set by the engine ECU 16, thereby to adjust the throttle opening.

As shown in FIG. 1, the engine ECU 16 includes a target opening setting portion 16A, and the throttle controller 160 includes a throttle opening feedback control portion 160A.

Figure 3:
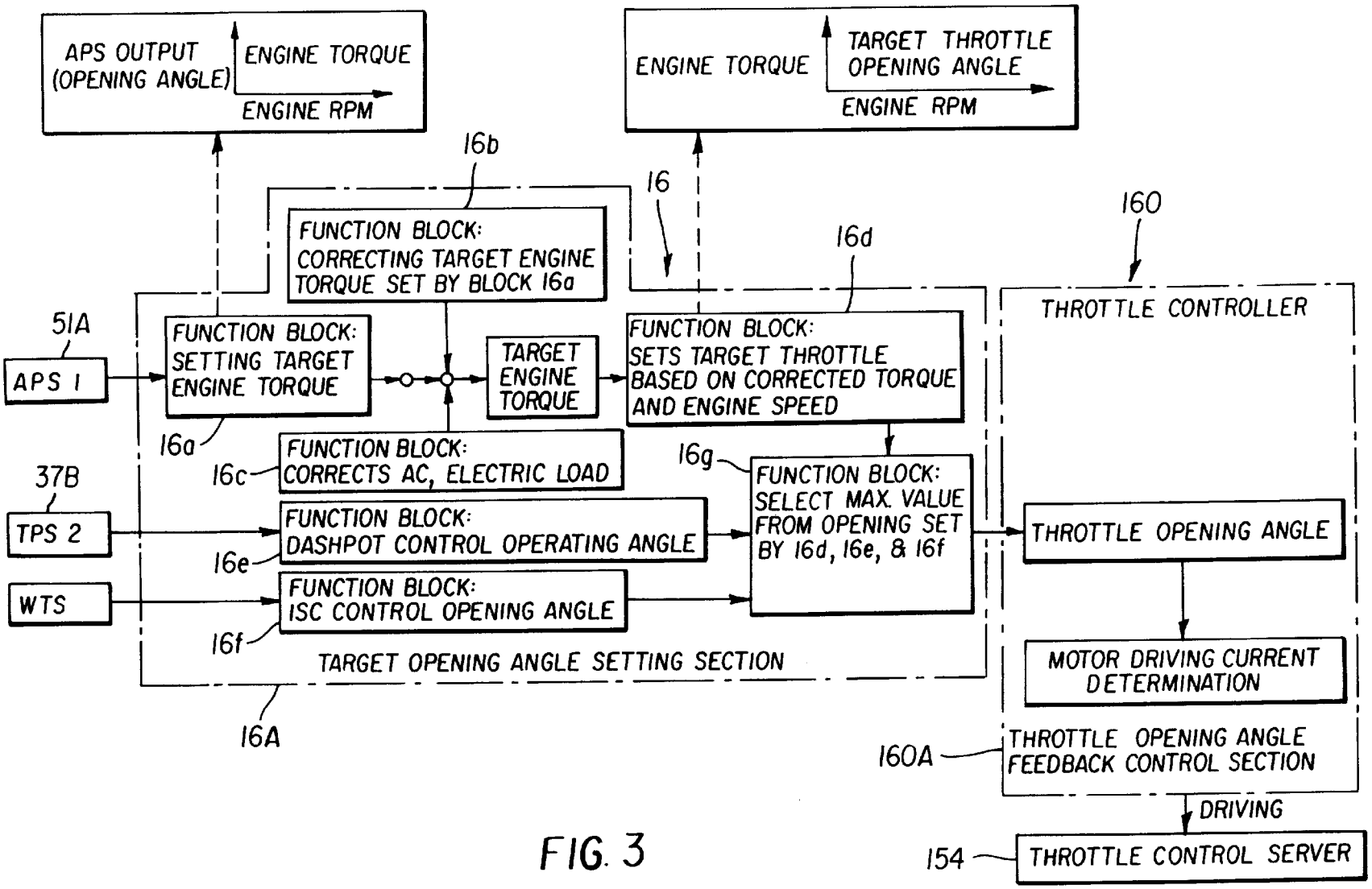
FIG. 3 is a block diagram showing an intake control system of the control apparatus of the engine equipped with the electronic throttle control device according to the embodiment of FIG. 1.

FIG. 3 is a control block diagram for explaining throttle opening control. As shown in FIG. 3, the target opening setting portion 16A of the engine ECU 16 includes a function block 16*a* for setting a target engine torque, based on the detected information from the first accelerator position sensor (APS1) 51A, and the engine speed obtained from the result of detection of the crank angle sensor 41 as shown in FIG. 2, and a function block 16*b* for correcting the target engine torque set by the block 16*a*, in terms of the intake air temperature and atmospheric pressure. The target opening setting portion 16A further includes a function block 16*c* for correcting the target engine torque set by the block 16*a*, in terms of the air conditioner, electric load, and the like, and a function block 16*d* for setting the target throttle opening based on the target engine torque thus corrected, and the engine speed.

The target opening setting portion 16A further includes a function block 16*e* for setting a dashpot control opening, based on detected information from the second throttle position sensor (TPS2) 37B, a function block 16*f* for setting an idle speed control opening, based on information on the temperature of cooling water of the engine which is detected by the water temperature sensor (WTS), and a function block 16*g* for selecting the maximum value from the openings set by the respective blocks 16*d*, 16*e*, 16*f*. The maximum opening thus selected is defined as the target opening of the throttle valve, which is then transmitted to the throttle controller 160.

The throttle controller 160 has a throttle opening feedback control portion 160A which determines motor driving current according to the target opening of the throttle valve received from the engine ECU 16, and controls driving of the actuator (also called throttle control servo) 154 with the current thus determined. At the same time, the feedback control portion 160A performs feedback control so as to control the throttle valve based on the throttle valve opening (actual opening) detected by the first throttle position sensor (TPS1) 37A.

In the control apparatus of the present embodiment, the accelerator position sensor 51 consists of two sensors, namely, first accelerator position sensor (APS1) 51A and second accelerator position sensor (APS2) 51B as shown in FIG. 1, to prepare for a failure in either of these sensors, as in the case of the throttle position sensors (TPS1, TPS2) 37A, 37B. These accelerator position sensors 51A, 51B function as driver s demand detecting means for detecting the output of the engine demanded or requested by the driver of the vehicle.

A signal indicative of an accelerator pedal position detected by the first accelerator position sensor (APS1) 51A is received by the engine ECU 16, to be used for setting the target opening of the throttle valve. On the other hand, a signal indicative an accelerator pedal position detected by the second accelerator position sensor (APS2) 51B is received by the throttle controller 160, and transmitted to the engine ECU 16 by a suitable communication system when the first accelerator position sensor 51A fails, so as to be used for setting the target opening of the throttle valve.

A signal indicative of a throttle position detected by the first throttle position sensor (TPS1) 37A is received by the throttle controller 160, to be used for feedback control of the throttle valve, and a signal indicative of a throttle position detected by the second throttle position sensor (TPS2) 37B is received by the engine ECU 16, to be used in dashpot control as described above, for example. When the first throttle position sensor (TPS1) 37A fails, the signal of the second throttle position sensor 37B is transmitted to the throttle controller 160 by a suitable communication system, and used for feedback control of the throttle valve.

On the other hand, the air bypass valve device 12 consists of the bypass passage 13 provided in parallel with the intake passage 5A of the throttle body 5, namely, between the upstream side and downstream side of the butterfly valve 151 of the electronic control throttle valve 15, an air bypass valve body 14 disposed in this bypass passage 13, a linear solenoid (not shown) for opening and closing the air bypass valve body 14, and the engine ECU 16 that controls the operation of the linear solenoid valve. The control system (air bypass valve control device) 120 for the air bypass valve device 12 consists of the linear solenoid and the engine ECU 16.

The air bypass valve device 12 is provided for dealing with the situation where the DBW 150 is at fault. In the present control apparatus, the engine ECU 16 and throttle controller 160 are adapted to diagnose various types of failures encountered in the DBW 150, so as to handle each of these failures using the air bypass valve device 12, for example, or performing other fail-safe operations, depending upon the type of the failure detected.

As shown in FIG. 1, a power supply relay 62 is provided in a power supply circuit interposed between a battery 61 and the throttle controller 160, for use in the fail-safe operations. This power supply relay 62 is turned on and off at appropriate times by the engine ECU 16. In FIG. 1, reference numeral 180 denotes an alarm lamp that is turned on when the air bypass valve device 12 is used to deal with a failure of the DBW 150.

Next, each of failure diagnosing operations will be explained. These failure diagnosing operations are performed by failure diagnosing means or failure detecting means 70 provided in the engine ECU 16 and throttle controller 160, based on various kinds of detected information and control information. More specifically, each of the diagnosing operations is performed in the manner as described below.

A. Position Feedback Failure

First, there will be described an operation to diagnose or detect a failure (position feedback failure) that occurs when the opening (position) of the electronic controlled throttle valve 15 cannot be controlled according to a command from the throttle controller 160.

The position feedback failure is diagnosed when a position feedback failure signal is received which indicates 1) sticking of the throttle valve system (including the case where the throttle valve is stuck at its fully closed position), and 2) a motor output open failure.

The diagnosis of the position feedback failure is conducted only when certain preconditions for diagnosing the failure are all satisfied. These preconditions are 1) the ignition switch is in the ON state, 2) the motor relay is in the ON state, or an error occurs in communications from the engine ECU 16 to the throttle controller 160, 3) the battery voltage Vb is equal to or higher than a predetermined level, and 4) no error occurs in communications from the throttle controller 160 to the engine ECU 16.

One type of position feedback failure is sticking of the electronic controlled throttle valve 15. This failure can be identified when the first throttle position sensor (APS1) 37A detects the opening of the electronic controlled throttle valve 15 that is stuck at a certain position. Where the opening information tells that the throttle valve 15 is stuck or fixed at a position where its opening is equal to or larger than a first predetermined opening (namely, when the valve is stuck at its open position), a fail-safe operation for dealing with sticking of the opened valve is performed. Where the opening information tells that the throttle valve 15 is stuck at a position where its opening is equal to or smaller than a second predetermined opening (namely, when the valve is stuck at its closed position), a fail-safe operation for dealing with sticking of the closed valve is performed.

The fail-safe operation for dealing with sticking of the open valve include the following steps:

1) The air bypass valve device 12 is turned off (closed), to restrict the amount of intake air.

2) The fuel injection mode is limited to the first lean-burn mode (compression stroke injection mode).

3) The fuel supply to part of cylinders (for example, three cylinders in the case of a six-cylinder engine) is stopped, namely, fuel cut is conducted with respect to some of the cylinders.

4) EGR control is stopped (EGR cut).

5) If the engine speed Ne is in a certain range of high-speed rotation (Ne≧3000 rpm), the fuel supply is stopped with respect to all of the cylinders, so as to avoid an excessive engine output.

6) Among various accessories driven by the engine, those which may be stopped without adversely influencing the operation of the engine are turned off, and operations of these accessories are halted or stopped (in this embodiment, the air conditioner is turned off).

In a fail-safe operation for dealing with sticking of the throttle valve at its closed position, the first lean-burn mode or second lean-burn mode is inhibited from being selected as the operating mode, so as to enable the mixture to be burned with high stability even with a small amount of intake air. Namely, the fail-safe operation for sticking of the closed valve is performed by switching the operating mode to a stoichiometric air fuel ratio mode (stoichiometric feedback combustion mode or open-loop combustion mode).

When the throttle valve is stuck at a position other than its open position (for example, when the valve is stuck at its closed position), it becomes difficult to ensure a sufficient amount of intake air flowing through the throttle valve. In the fail-safe operation for dealing with this case, therefore, the air bypass valve device 12 is utilized to perform a air bypass operation which will be described later, so as to ensure a sufficient amount of intake air.

B. Motor Failure

The motor failure is caused by 1) earth current passing through the earth from the motor, or 2) excessive current flowing through the motor, and this failure is diagnosed upon receipt of a failure signal indicative of the earth current or excessive current from the output of the motor. The diagnosis of the motor failure is conducted only when all of the following preconditions: 1) the motor relay is ON, and 2) no error occurs in communications from the throttle controller 160 to the engine ECU 16, are satisfied. When the motor failure is detected, an air bypass operation as described later is performed.

C. TPS Failure

The engine system includes two throttle position sensors, i.e., first and second throttle position sensors (TPS1, TPS 2) 37A, 37B. A failure of the first throttle position sensor (TPS1) 37A used by the throttle controller 160 for feedback control is caused by 1) opening or short-circuiting of its current circuit, or 2) poor linearity. A failure of the second throttle position sensor (TPS2) 37B is caused by 3) abnormality in its characteristics, or 4) opening or short-circuiting of its current circuit. The failure of the throttle position sensor 37A, 37B is diagnosed upon receipt of a failure signal associated with each of the sensors.

The diagnosis of the TPS failure is conducted only when all of the following preconditions: 1) the ignition switch is ON, and 2) no error occurs in communications from the throttle controller 160 to the engine ECU 16, are satisfied.

Since a problem arises in the feedback control of the throttle valve when the first throttle position sensor (TPS1) 37A is at fault, an operation to limit the operating region of the engine is performed. If the second throttle position sensor (TPS2) 37B has already been at fault when the first throttle position sensor (TPS1) fails, or if there is an error or abnormality in communications from the engine ECU 16 to the throttle controller 160, an air bypass operation is performed.

D. Communication Failure

The engine ECU 16 and the throttle controller 160 communicate with each other. Thus, a communication failure is caused by either an error in communications from the engine ECU 16 to the throttle controller 160, or an error in communications from the throttle controller 160 to the engine ECU 16.

A communication failure due to an error in the communications from the engine ECU 16 to the throttle controller 160 is diagnosed when the throttle controller 160 receives a communication failure signal from the engine ECU 16.

The diagnosis of the communication failure is conducted only when all of the following preconditions: 1) the battery voltage Vb is equal to or higher than a predetermined level, and 2) no error arises in communications from the throttle controller 160 to the engine ECU 16, are satisfied.

When the communications from the engine ECU 16 to the throttle controller 160 fails, the target opening of the throttle valve set by the engine ECU 16 cannot be received by the throttle controller 160, resulting in a high possibility that the amount of intake air is not appropriately controlled. To prevent this problem, a fail-safe operation as follows is performed.

1) The engine is inhibited from operating in a lean-burn mode.

2) The cruise control is inhibited.

3) If the engine speed Ne is in a certain range of high-speed rotation (for example, Ne≧3000 rpm), fuel cut is conducted with respect to all of the cylinders, so as to avoid an excessive engine output.

A failure due to an error in communications from the throttle controller 160 to the engine ECU 16 is diagnosed when any of the following conditions is satisfied.

1) A checksum error is detected.

2) An overrun framing error is detected.

3) Communications are not completed in a predetermined time (for example, 25 msec).

The diagnosis of this failure is conducted only when all of the following preconditions: 1) the battery voltage Vb is equal to or higher than a predetermined level, and 2) a cruising switch is in the OFF state, are satisfied.

Upon a failure of communications from the throttle controller 160 to the engine ECU 16, too, control signals, or the like, cannot be transmitted from the throttle controller 160 to the engine ECU 16, resulting in a high possibility that the amount of intake air is not appropriately controlled. To prevent this problem, a fail-safe operation having the following steps is performed.

1) A signal indicative of a communication failure is transmitted to the throttle controller 16.

2) The engine is inhibited from operation in a lean-burn mode.

3) The cruise control is inhibited.

4) If the engine speed Ne is in a certain range of high-speed rotation (for example, Ne≧3000 rpm), fuel cut is conducted with respect to all of the cylinders, so as to avoid an excessive engine output.

5) When a brake pedal is depressed, the upper limit of the target opening of the throttle valve 15 directed or set by the engine ECU 16 is clipped.

E. Throttle Controller Failure

A failure of the throttle controller 160 is diagnosed when all of the conditions (1) to (4) as indicated below are satisfied, or all of the conditions (5) to (8) as indicated below are satisfied.

(1) The ignition switch is in the ON state.

(2) There is no abnormality in the second accelerator position sensor (APS2) 51 and the second throttle position sensor (TPS2) 37B.

(3) No error arises in communications from the engine ECU 16 to the throttle controller 160.

(4) $|(V_{APS2})/2-(5v-V_{TPS2})|\geqq 1v$ (5) The ignition switch is in the ON state.

(6) There is no abnormality in the second accelerator position sensor (APS2) 51B and the second throttle position sensor (TPS2) 37B.

(7) No error arises in communications from the throttle controller 160 to the engine ECU 16.

(8) $|(\text{engine ECU command opening voltage}-V_{TPS2})|\geqq 1v$

If the failure of the throttle control 160 is diagnosed as described above, an air bypass operation as described later is performed.

F. APS failure

The engine system of the present embodiment includes two accelerator position sensors, namely, the first accelerator position sensor (APS1) 51A and second accelerator position sensor (APS2) 51B. These first and second accelerator position sensors (APS1, APS2) 51A, 51B may fail because of (1) short-circuiting of its current circuit, or opening of a ground circuit (GND) of the sensor, (2) opening of the current circuit, or short-circuiting of the ground circuit (GND) of the sensor, or (3) an abnormality in its characteristics.

The failure of the second accelerator position sensor (APS2) 51B due to short-circuiting of the current circuit or the failure due to sensor GND opening is diagnosed when both of the following preconditions: (1) there is no error in communications, and (2) there is no abnormality in the first accelerator position sensor (APS1) 51A, are satisfied, and when both of the conditions as follows are satisfied.

(1) The output value $V_{APS2}$ of the second accelerator position sensor 51B is equal to or higher than a predetermined value V1 (for example, $V_{APS2}\geqq 4.5v$ when V1 is set to 4.5v).

(2) The output value $V_{APS1}$ of the first accelerator position sensor 51A is within a predetermined range (for example, $0.2v\leqq V_{APS1}\leqq 2.5v$).

The failure of the second accelerator position sensor (APS2) 51B due to opening of the current circuit or the failure due to sensor GND short-circuiting is diagnosed when the output value $V_{APS2}$ of the second accelerator position sensor 51B is smaller than a predetermined value V2 (for example, $V_{APS2}<0.2v$ if V2 is set to 0.2v).

The failure of the first accelerator position sensor (APS1) 51A due to short-circuiting of its current circuit, or the failure due to sensor GND opening is diagnosed when both of the following preconditions: (1) there is no error in communications, and (2) there is no abnormality in the second accelerator position sensor (APS2) 51B, are satisfied, and when both of the conditions as follows are satisfied.

(1) The output value $V_{APS1}$ of the first accelerator position sensor 51A is equal to or higher than a predetermined value V3 (for example, $V_{APS1}\geqq 4.5v$ when V3 is set to 4.5v).

(2) The output value $V_{APS2}$ of the second accelerator position sensor 51B is within a predetermined range (for example, $0.2v\leqq V_{APS2}\leqq 2.5v$).

The failure of the first accelerator position sensor (APS1) 51A due to opening of its current circuit or the failure due to sensor GND short-circuiting is diagnosed when the output value $V_{APS1}$ of the first accelerator position sensor 51A is equal to or smaller than a predetermined value V4 (for example, $V_{APS1}<0.2v$ if V4 is set to 0.2v) .

An abnormality in characteristics of the accelerator position sensors is detected when a precondition that the idle switch is ON (namely, the engine is in an idling operation) is satisfied, and when $V_{APS2}\geqq 1.1v$.

When the second accelerator position sensor 51B is found to be at fault, a fail-safe operation having the following steps is performed.

(1) $V_{APS}$ is set to $V_{APS1}/2$.

(2) The engine is inhibited from operating in a lean-burn mode.

(3) The cruise control is inhibited.

(4) The upper limit of the engine output is clipped.

Where an error arises in communications from the throttle valve controller 160 to the engine ECU 16 after detecting a failure of the second accelerator position sensor (APS2) 51B, an air bypass operation as described later is performed.

When the first accelerator position sensor 51 is found to be at fault, a fail-safe operation having the following steps is performed.

(1) $V_{APS}$ is set to $V_{APS2}/2$.

(2) The engine is inhibited from operating in a lean-burn mode.

(3) The cruise control is inhibited.

(4) The upper limit of the engine output is clipped.

If the second accelerator position sensor (APS2) 51B has been already at fault, an air bypass operation as described later is performed.

Upon detection of an abnormality in characteristics of the accelerator position sensors, the following steps are executed.

(1) $V_{APS}$ is set to $V_{APS1}/2$.

(2) The engine is inhibited from operating in a lean-burn mode.

(3) The cruise control is inhibited.

(4) The upper limit of the engine output is clipped.

If the first accelerator position sensor (APS1) 51A has been already at fault, an air bypass operation as described later is performed.

G. Air Bypass Valve failure

A failure of the air bypass valve device 12 is diagnosed when (1) the air bypass valve solenoid is in the OFF state, and (2) the terminal voltage Lo is detected.

When a failure of the air bypass valve device 12 is detected, a fail-safe operation having the following steps is performed.

(1) The first lean-burn mode is selected. Namely, the operating mode of the engine is limited to the compression stroke injection mode, so as to limit the output of the engine to a small value.

(2) If the engine speed Ne is in a certain range of high-speed rotation (for examples, Ne≧3000 rpm), fuel cut is conducted with respect to all of the cylinders, so as to prevent the engine output from being excessively large.

(3) EGR (exhaust gas recirculation) is cut or stopped.

(4) The feedback control of the engine speed for controlling an idle speed is inhibited.

In the air bypass operation, the air bypass valve device 12 is actuated so as to supply air into each combustion chamber of the engine. The air bypass valve body 14 of this air bypass valve device 12 is normally controlled to be placed in the ON/OFF state, and the air bypass valve device 12 is actuated by placing the air bypass valve body 14 in the ON state.

During the air bypass operation, therefore, the vehicle speed is controlled only through brake operations by the driver, without controlling the amount of intake air nor controlling the engine output itself.

Accordingly, the amount of intake air is restricted during operation of the air bypass valve device 12, so as to prevent the engine output from being excessively large. Namely, during the operation of the air bypass valve device 12, a suitable amount of intake air is supplied to each combustion chamber so that a constant running output can be obtained, and the vehicle can be decelerated or stopped without any problem when a brake is applied by the driver.

More specifically, the air bypass operation is performed by executing the following steps.

A: The fuel cut operation as follows is performed.

1) The following cases (1)–(4) are considered during forward running of the vehicle.

(1) When the output value of the second accelerator position sensor (APS2) 51B is lower than a predetermined value [$(5v-V_{APS2})>1.5v$], the fuel is injected into all of the cylinders.

(2) When the output value of the second accelerator position sensor (APS2) 51B is equal to or higher than a predetermined value [$(5v-V_{APS2})\leqq 1.5v$], the fuel injection into part of the cylinders (for example, three cylinders if the engine has a total of six cylinders) is halted or stopped.

(3) When the second accelerator position sensor (APS2) 51B is at fault, the fuel injection into part of the cylinders (for example, three cylinders in the case of a six-cylinder engine) is stopped.

(4) When a brake pedal is depressed, the fuel injection into part of the cylinders (for example, three cylinders in the case of a six-cylinder engine) is stopped.

2) When the vehicle is running backward, the fuel injection into part of the cylinders (three cylinders in the case of a six-cylinder engine) is stopped.

B: The motor relay is turned off.

C: The air bypass valve device 12 is turned on. (When a brake pedal is depressed (when the brake switch is ON), the air bypass valve device 12 is operated under duty control at a frequency of 5 Hz for a predetermine period of time (for example, 2 seconds).

D: The engine is inhibited from operating in a lean-burn mode.

E: The cruise control is inhibited.

F: The feedback control of the engine speed is inhibited.

G: The alarm lamp 180 is turned on.

H: Once the engine system is brought into the air bypass mode, it does not return to a normal mode until the ignition switch is turned off.

In each of the fail-safe operations as described above, the engine is inhibited from operating in the lean-burn mode. Since the lean-burn mode is successfully established as long as the throttle valve can be controlled with high accuracy, the air-fuel mixture may be burned with reduced stability if the lean-burn mode is selected while the throttle position sensor is at fault. The lean-burn mode is inhibited so as to avoid reduction in the combustion stability.

Next, a failure diagnosing operation will be now explained in regard to a position feedback failure due to sticking of the electronic controlled throttle valve 15.

To perform the failure diagnosing operation, the throttle controller 160 is provided with failure detecting means 70, as shown in FIG. 1, which is adapted to determine whether a failure occurs due to sticking of the electronic controlled throttle valve 16. According to the result of this diagnosis, the engine is placed in an appropriate operating mode.

The failure detecting means 70 reads the target opening that is set based on detected information from the accelerator position sensor 51A, and also reads the opening of the electronic controlled throttle valve 15 detected by the second throttle position sensor (TPS2) 37B. The failure detecting means 70 then compares the opening of the electronic controlled throttle valve 15 with the target opening, and determines that a failure arises due to sticking of the electronic controlled throttle valve 15 if a difference between these target and actual openings is kept being greater than a predetermined opening (for example, 1º) over a predetermined time (for example, 500 ms).

The failure detecting means 70 determines that the throttle valve 15 is stuck or fixed at its open position when the opening of the electronic controlled throttle valve 15 detected by the second throttle position sensor (TPS2) 37B is not reduced in spite of a decrease in the target opening that is set based on detected information from the accelerator position sensor 51A (namely, the opening of the valve 15 is kept larger than the first predetermined opening). On the other hand, the failure detecting means 70 determines that the throttle valve 15 is stuck at its closed position when the opening of the electronic controlled throttle valve 15 is not increased in spite of an increase in the target opening that is set based on detected information from the accelerator position sensor 51A (namely, the opening of the valve 15 is kept smaller than the second predetermined opening).

If the failure detecting means 70 determines that the throttle valve 15 is stuck or fixed at its open position where the throttle opening is kept being larger than the first predetermined opening, the fail-safe operation for dealing with sticking of the open valve as described above is implemented. If the failure diagnosing means 70 determines that the throttle valve 15 is stuck at its closed position where the throttle opening is kept being smaller than the second predetermined opening, the fail-safe operation for dealing with sticking of the closed valve as described above is implemented.

In the meantime, the air bypass operation or other operation is performed upon a failure of the throttle valve 15 other than sticking of the valve at its open position. If the vehicle is running forward during the air bypass operation, the fuel is injected into all of the cylinders if the amount of depression of the accelerator pedal is equal to or larger than a predetermined value, and the fuel injection into part of the cylinders is stopped if the amount of depression of the accelerator pedal is smaller than the predetermined value.

If the amount of depression of the accelerator pedal is small, namely, if the driver does not demand or request an increase in the engine torque (engine output), the fuel injection into a part of the cylinders (three cylinders out of six cylinders in this embodiment) is stopped, regardless of the operating region of the engine, so as to lower the engine output. If the amount of depression of the accelerator pedal is large, namely, if the driver demands an increase in the engine torque (engine output), on the other hand, the fuel is injected into all of the cylinders, without conducting the fuel cut with respect to part of the cylinders, to provide a sufficiently large engine output. The control function to lower the engine output by stopping the fuel injection as needed is called output reducing means (not illustrated).

As described above, the output reducing means always stops fuel injection into a part of cylinders (three cylinders out of six cylinders in this embodiment) while the vehicle is running backward, thereby to surely reduce the engine output during backward-running of the vehicle.

The output reducing means also has a function to stop fuel injection into all of the cylinders when the engine speed becomes equal to or greater than a predetermined value (for example, 3000 rpm). Namely, where the throttle valve 15 is stuck or fixed at its fully opened position, the output reducing means can avoid an increase in the engine speed, thereby to prevent the engine from being damaged, or make the driver less uncomfortable due to the increase in the engine speed. Further, in the case where the accelerator position sensor fails, for example, the output reducing means serves to lower the engine output if the engine speed exceeds the predetermined value, and thus inform the drive of an abnormality in the sensor. Even in the case where a double failure of the DBW system cannot be detected, the engine speed is prevented from being excessively increased. It is, however, the be noted that the fuel cut need not be conducted in the air bypass mode (during an air bypass operation), since the output produced in this mode is preliminarily determined.

Even where no failure is detected in the failure detecting operation to diagnose a position feedback failure associated with the electronic controlled throttle valve, there is a possibility that a failure occurs in the accelerator position sensor APS 51A, 51B serving as accelerator position detecting means. In this case, the amount of intake air cannot be accurately controlled, and therefore the stability with which an air-fuel mixture is burned deteriorates if the first lean-burn mode as one type of lean-burn mode is selected, thus giving the driver a sense of uneasiness.

In the control apparatus of the internal combustion engine according to the present embodiment, therefore, a failure diagnosing or detecting operation to diagnose an APS failure is performed in the manner as described above (refer to the above description of "APS failure").

To enable this failure detecting operation, the throttle controller 160 is provided with an accelerator position failure detecting means (not illustrated), which is adapted to determine whether the accelerator position sensor APS 51A, 51B is at fault. If a failure of the accelerator position sensor (APS) 51A, 51B is detected by this accelerator position failure detecting means, the amount of intake air cannot be appropriately controlled, and therefore the DBW drives the electronic controlled throttle valve 15 so that the valve is positioned with a certain small opening, while the stoichiometric combustion mode is selected as the operating mode of the engine.

With the control apparatus of the internal combustion engine equipped with the electronic throttle control device constructed as described above according to one embodiment of the present invention, fail-safe operations as illustrated in FIG. 4, for example, are performed in the event of a failure of an intake control system, namely, a failure of the electronic throttle control device (DBW) 150 and that of a system including the air bypass valve device 12.

Initially, a routine to diagnose a failure of the air bypass valve device is executed in step A10. In step A20, the failure of the air bypass valve device is judged by determining (1) whether the air bypass valve solenoid is in the OFF state or not, and (2) whether the terminal voltage Lo is detected or not, and the failure of the air bypass valve is diagnosed when (1) the air bypass valve solenoid is in the OFF state, and (2) the terminal voltage Lo is detected. If an affirmative decision (Yes) is obtained in step A20, namely, if the failure of the air bypass valve device is detected, an engine output restricting operation is performed in step A30. More specifically, the following steps are executed.

(1) The operating mode of the engine is forced to be placed in the first lean-burn mode (compression stroke injection mode), so that the engine output is restricted.

(2) When the engine speed Ne becomes equal to or greater than a predetermined value (for example, 3000 rpm), the fuel supply or injection into all cylinders is stopped, namely, the fuel cut is conducted with respect to all cylinders, so as to prevent the engine output from being excessively large.

(3) The EGR is cut or stopped, thus giving higher priority to stable combustion than exhaust emission control.

(4) The feedback control of the engine speed associated with idle speed control is inhibited, giving higher priority to stable combustion.

The failure of the air bypass valve 12 may occur when the valve 12 is fixed or stuck at its open position, namely, when the valve 12 is being kept in the open state. This situation is favorable during acceleration of the vehicle, since the amount of the intake air is sure to be greater than a certain value, thus making it easy to produce an engine output. The same situation, however, is undesirable when the vehicle is being decelerated or stopped, and may cause an excessively large engine output upon starting of the vehicle. In the present embodiment, this problem may be solved by the above engine output restricting operation, i.e., by selecting the first lean-burn mode, or cutting the fuel when the engine speed is increased up to a certain point. This operation prevents the engine output from being excessively large, and makes it possible to safely transport the vehicle to a desired location (for example, repair shop), thus reducing a burden on the driver when the failure occurs.

If no failure of the air bypass valve is detected, a negative decision (No) is obtained in step A20, and the control flow goes to step A40 to determine whether the APS fail flag $Ffail_1$ is 1 or not. This APS fail flag $Ffail_1$ is set to 1 if one of the accelerator position sensors (APS) 51A, 51B fails, and set to 0 in other cases. If the flag $Ffail_1$ is 1, the control flow goes to step A80 to execute an APS double fault diagnosing routine. If the flag $Ffail_2$ is not 1, the control flow goes to step A50 to execute an APS failure diagnosing routine.

In the APS failure diagnosing routine of step S50, the above-described APS failure diagnosing operation is performed with respect to each of the first accelerator position sensor (APS1) 51A and the second accelerator position sensor (APS2) 51B, to diagnose a failure due to (1) short-circuiting of its current circuit, or sensor GND (ground) opening, (2) opening of the current circuit, or sensor GND (ground) short-circuiting, or (3) any abnormality in its characteristics.

If the failure of one of the accelerator position sensors 51A, 52A is diagnosed, step A70 is executed, and then step S80 is executed to determine whether the APS failure is a double failure, namely, whether both of the first and second accelerator position sensors (APS1, APS2) are at fault. Where both of the accelerator position sensors are at fault, the control flow goes to step A300 to perform the air bypass operation. Where the APS failure is not a double failure, namely, only one of the two accelerator position sensors is at fault, the control flow goes to step A90.

Step A90 determines whether the brake switch is ON or not, namely, whether a brake is being applied or not. If a brake is being applied, the control flow goes to step A100, to clip the command value of the throttle opening to a predetermined upper limit value to restrict the amount of intake air, thereby to restrict the engine output. If no brake is being applied, the control flow goes to step A120 to perform a fail-safe operation depending upon which of the first and second accelerator position sensors 51A, 51B is at fault.

More specifically, when the second accelerator position sensor 51B is at fault, (1) $V_{APS}$ is set to $V_{APS1}/2$, (2) the engine is inhibited from operating in a lean-burn mode, (3) the cruise control is inhibited, and (4) the engine output is restricted to the upper limit by clipping, namely, the fuel cut is conducted when the engine operates at a high rotating speed (for example, $Ne \geqq 3000$). If an error arises in communications from the throttle controller 160 to the engine ECU 15 after detection of the failure of the second accelerator position sensor (APS2) 51B, the air bypass operation is performed.

When the first accelerator position sensor 51A is at fault, (1) $V_{APS}$ is set to $V_{APS2}/2$, (2) the engine is inhibited from operating in a lean-burn mode, (3) the cruise control is inhibited, and (4) the engine output is restricted to the upper limit by clipping. If the second accelerator position sensor (APS2) 51B has been already at fault, the air bypass operation is performed.

When any abnormality in characteristics of the accelerator position sensor is detected, (1) $V_{APS}$ is set to $V_{APS1}/2$, (2) the engine is inhibited from operating in a lean-burn mode, (3) the cruise control is inhibited, and (4) the engine output is restricted to the upper limit by clipping, namely, the fuel cut is conducted when the engine operates at a high rotating speed (for example, $Ne \geqq 3000$). If the first accelerator position sensor (APS1) 51A has been already at fault, the air bypass operation is performed.

When no failure of the accelerator position sensor(s) is diagnosed, the control flow goes from step A60 to step A130 to execute an ETV diagnosing routine.

In this ETV diagnosing routine, a failure of the throttle controller is diagnosed. In step A140, it is determined that the throttle controller is at fault in the case where (1) the ignition switch is ON, (2) no abnormality is detected with respect to the second accelerator position sensor (APS2) and the second throttle position sensor (TPS2), (3) an error arises in communications from the engine ECU 16 to the throttle controller 160, and (4) $|(V_{APS})/2-(5v-V_{TPS2})| \geqq 1v$, or the case where (5) the ignition switch is ON, (6) no abnormality is detected with respect to the second accelerator position sensor (APS2) 51B and the second throttle position sensor (TPS2) 37B, (7) an error occurs in communications from the throttle controller 160 to the engine ECU 16, and (8) $|(\text{engine ECU command opening voltage}-V_{TPS2})| \geqq 1v$.

If the failure of the throttle controller is diagnosed, namely, if an affirmative decision (Yes) is obtained in step A140, the control flow goes to step A300 in which the air bypass operation is performed. If no failure is diagnosed, namely, if a negative decision (No) is obtained in step A300, the control flow goes to step A150 to execute a communication failure diagnosing routine.

In this communication failure diagnosing routine, a communication failure due to an error in communications from the engine ECU 16 to the throttle controller 160, or a communication failure due to an error in communications from the throttle controller 160 to the engine ECU 16 is diagnosed.

The presence of an error in communications from the engine ECU 16 to the throttle controller 160 is determined under conditions that 1) the battery voltage Vb is equal to or higher than a predetermined level, and 2) no error is present in communications from the throttle controller 160 to the engine ECU 16. A communication failure due to the error in the communications from the engine ECU 16 to the throttle controller 160 is diagnosed when the throttle controller 160 receives a communication failure signal from the engine ECU 16.

The presence of an error in communications from the throttle controller 160 to the engine ECU 16 is determined under conditions that (1) the battery voltage Vb is equal to or higher than a predetermined level, (2) a cruising switch to perform cruise control is in the OFF state, and a failure in the communications is diagnosed when (1) a checksum error is detected, (2) an overrun framing error is detected, (3) communications are not completed in a predetermined period of time (for example, 25 msec).

If a communication failure is diagnosed, namely, if an affirmative decision (Yes) is obtained in step A170, a fail-safe operation to deal with the communication failure is performed.

More specifically, when the communications from the engine ECU 16 to the throttle controller 160 fails, there is a high possibility that the amount of intake air cannot be appropriately controlled. In this case, (1) the engine is inhibited from operating in a lean-burn mode, (2) the cruise control is inhibited, and (3) fuel supply or injection into all cylinders of the engine is cut or stopped when the engine speed Ne is in a certain range of high-speed rotation (for example, $Ne \geqq 3000$ rpm), thereby to avoid an excessively large engine output.

When the communications from the throttle controller 160 to the engine ECU 16 fails, there is a high possibility that the amount of intake air cannot be appropriately controlled. In this case, (1) a signal indicative of a communication failure is transmitted to the throttle controller 16, (2) the engine is inhibited from operating in a lean-burn mode, (3) the cruise control is inhibited, (4) fuel supply or injection into all cylinders of the engine is cut or stopped when the engine speed Ne is in a certain range of high-speed rotation (for example, Ne≧3000 rpm), thereby to avoid an excessively large engine output, and (5) the upper limit of the target opening of the throttle valve directed by the engine ECU 16 is clipped when the brake pedal is depressed.

If no communication failure is diagnosed, namely, if a negative decision (No) is obtained in step A160, the control flow goes to step A180 to execute a motor failure diagnosing routine.

In the motor failure diagnosing routine, the diagnosis of a motor failure is conducted under preconditions that (1) the motor relay is ON, and (2) no error is present in communications from the throttle controller 160 to the engine ECU 16, and a motor failure is diagnosed or detected when a failure signal is received which indicates the presence of earth current passing through the earth from the motor, or excessive current flowing through the motor.

If the motor failure is diagnosed, namely, if an affirmative decision (Yes) is obtained in step A190, the control flow goes to step A300, to perform an air bypass operation. If no motor failure is diagnosed, namely, if a negative decision (No) is obtained in step A190, the control flow goes to step A200 to execute a TPS failure diagnosing routine.

In the TPS failure diagnosing routine, a TPS failure is diagnosed under preconditions that (1) the ignition switch is ON, and (2) no error is present in communications from the throttle controller 160 to the engine ECU 16, when a failure signal indicative of each type of failure as follows is received. Namely, a failure of the first throttle position sensor (TPS1) 37A used by the throttle controller 160 for feedback control is caused by (1) opening or short-circuiting of its current circuit, or (2) poor linearity, and a failure of the second throttle position sensor (TPS2) 37B is caused by (3) abnormality in its characteristics, or (4) opening or short-circuiting of the current circuit.

Based on the result of determination in the TPS failure diagnosing routine as described above, step A210 is executed to determine whether either of the throttle position sensor (TPS1) 37A or throttle position sensor (TPS2) 37B is at fault or not. If it is determined that either of the throttle position sensors (TPS1, TSP2) 37A, 37B is at fault, step A220 is executed to determine whether both of these throttle position sensors (TPS1, TPS2) 37A, 37B are at fault.

If both of the throttle position sensors (TPS1, TPS2) 37A, 37B are at fault, the control flow goes to step A300 in which the air bypass operation is performed. If not, namely, if only one of the throttle position sensors (TPS1, TPS2) 37A, 37B is at fault, the control flow goes to step A230 in which a lean-mode inhibiting operation is performed. Since the lean-burn mode is successfully established only when highly accurate throttle control is feasible, the stability with which the mixture is burned (combustion stability) may deteriorate if this mode is selected when the throttle position sensor 37A or 37B is at fault. To avoid this problem, the engine is prevented from operating in the lean-burn mode.

If neither of the throttle position sensors (TPS1, TPS 2) 37A, 37B is at fault, namely, if a negative decision (No) is obtained in step S210, the control flow goes to step S240 to execute a position feedback failure diagnosing routine (POS F/B failure diagnosing routine).

In the position feedback failure diagnosing routine, a failure in position feedback, namely, (1) sticking of the throttle valve (including the case where the valve is kept being fully closed), or (2) a motor output opening, is diagnosed. This diagnosis is conducted under preconditions that (1) the ignition switch is in the ON state, 2) the motor relay is in the ON state, or there is an error in communications from the engine ECU 16 to the throttle controller 160, (3) the battery voltage Vb is equal to or higher than a predetermined value, and 4) there is no error in communications from the throttle controller 160 to the engine ECU 16. The failure is diagnosed when a position feedback failure signal is received.

If a position feedback failure is not detected, namely, a negative decision (No) is obtained in step A250, no fail-safe operation is performed (the control flow goes to RETURN). If a position feedback failure is detected, namely, an affirmative decision (Yes) is obtained in step A250, the control flow goes to step A260 to determine whether the second throttle valve opening $V_{TPS2}$ is equal to or greater than a predetermined value K1 (K1: value close to the fully opened position of the valve). If the second throttle valve opening $V_{TPS2}$ is equal to or greater than the predetermined value K1, the control flow goes to step A280 to perform a fail-safe operation for dealing with sticking of the open valve.

If step A260 determines that the second throttle valve opening $V_{TPS2}$ is not greater than the predetermined valve K1, step A270 is then executed to determine whether the second throttle valve opening $V_{TPS2}$ is equal to or smaller than a predetermined value K2 (K2: value close to the fully closed position of the valve). If the second throttle valve opening $V_{TPS2}$ is equal to or smaller than the predetermined value K2, the control flow goes to step A290 to perform a fail-safe operation for dealing with sticking of the closed valve.

If the second throttle valve opening $_{VTPS2}$ is between the predetermined value K1 and predetermined value K2, the control flow goes to step A300 to perform an air bypass operation.

In the fail-safe operation for dealing with sticking of the opened valve in step A280, (1) the air bypass valve 12 is turned off (closed), so as to restrict the amount of intake air, (2) the fuel injection mode is limited to the first lean-burn mode (compression stroke injection mode), (3) the fuel supply or injection into part of cylinders (for example, three cylinders in the case of a six-cylinder engine) is stopped, namely, fuel cut is conducted with respect to part of the cylinders, (4) EGR control is stopped (EGR cut), (5) the fuel supply or injection into all of the cylinders is stopped (fuel cut) when the engine speed Ne is in a certain range of high-speed rotation (Ne≧3000 rpm), so as to avoid an excessively large engine output, and (6) those of accessories driven by the engine, which may be stopped without adversely influencing the operation of the engine, are turned off and their operations are stopped (in this embodiment, the air conditioner is turned off).

In the control device of the present embodiment, when the throttle valve 15 is stuck at a position where its opening is larger than a predetermined value, the lean-burn mode is selected, or fuel injection into a certain number of cylinders is stopped, so as to surely lower the output of the engine, and avoid an excessively large output that is not desired by the driver, thus assuring stable running that meets with the driver s demand or intention.

If the engine speed Ne is in a certain range of high rotation (Ne≧3000 rpm), the fuel supply to all of the cylinders is stopped (fuel cut), thereby to prevent an excessive increase in the engine speed, and an excessive increase in the engine output. Where the driver applies brakes in order to control the speed of the vehicle, therefore, the frequency of braking action can be reduced, with a result of reduced burdens both on the driver and the brake system.

Limiting the increase of the engine speed and the increase of the engine output as described above also makes it possible to inform the driver of occurrence of a failure.

While the fuel cut is implemented when the engine speed Ne becomes 3000 rpm or higher, by way of example, the engine speed that provides a basis for starting the fuel cut is not limited to this value, but may be set to other appropriate value depending upon the type of the engine and others.

When the control device determines that the throttle valve 15 is stuck at a position where its opening is larger than the above-indicated first predetermined value, the load of accessories of the engine is reduced, so as to achieve stable combustion in the lean-burn mode, thereby assuring stable running while keeping the driver from feeling uncomfortable because of variations in the output of the engine.

In the case of other types of failures of the throttle valve (including sticking of the valve at its closed position), the air bypass operation as described above is performed, using the air bypass valve 12 so as to ensure a sufficient amount of intake air.

In the air bypass operation performed upon a failure of the throttle valve while the vehicle is running forward, the fuel is injected into all of the cylinders if the amount of depression of the accelerator pedal is equal to or larger than a predetermined value, and the fuel injection into part of the cylinders is stopped if the amount of depression of the accelerator pedal is smaller than the predetermined value.

With this arrangement, where the driver does not demand an increase in the engine torque, the fuel injection into part of cylinders (three cylinders out of six cylinders in this embodiment) is stopped so as to lower the engine output. Where the driver demands an increase in the engine torque, on the other hand, the above operation to stop fuel injection into part of the cylinders is not performed, namely. the fuel is injected into all of the cylinders, to ensure a sufficiently large engine output, so that the resulting engine output reflects the driver s demand for an increase in the output.

While the vehicle is running backward, the fuel injection into part of the cylinders (three cylinders out of six cylinders in the present embodiment) is always stopped, so that the engine output can be surely reduced, or the engine output is prevented from being excessively large, thus making it easy for the driver to operate the vehicle during backward running. Namely, the drivability is improved during backward driving.

When the control device determines that the throttle valve 15 is stuck at a position where its opening is smaller than the above-indicated second predetermined value, the lean-burn mode is inhibited, so as to ensure a sufficiently large output of the engine, avoiding such a situation that the engine cannot produce an output as requested by the driver, and thus assuring stable running that meets with the driver s demand.

Even where no failure of the electronic throttle control device is diagnosed by the failure detecting means 70, the opening of the throttle valve 15 is controlled to a certain small value and selection of the lean-burn mode is inhibited when a failure of accelerator position detecting means is diagnosed by the accelerator position failure detecting means. This also prevents unstable combustion, and assures stable running while keeping the driver from feeling uneasy.

In the internal combustion engine of the present embodiment, the fail-safe operation for dealing with sticking of the open valve is performed when it is determined that the throttle valve is stuck at its open position, and the fail-safe operation for dealing with sticking of the closed valve is performed when it is determined that the throttle valve is stuck at its closed position. However, only one of these operations may be performed.

Figure 5:
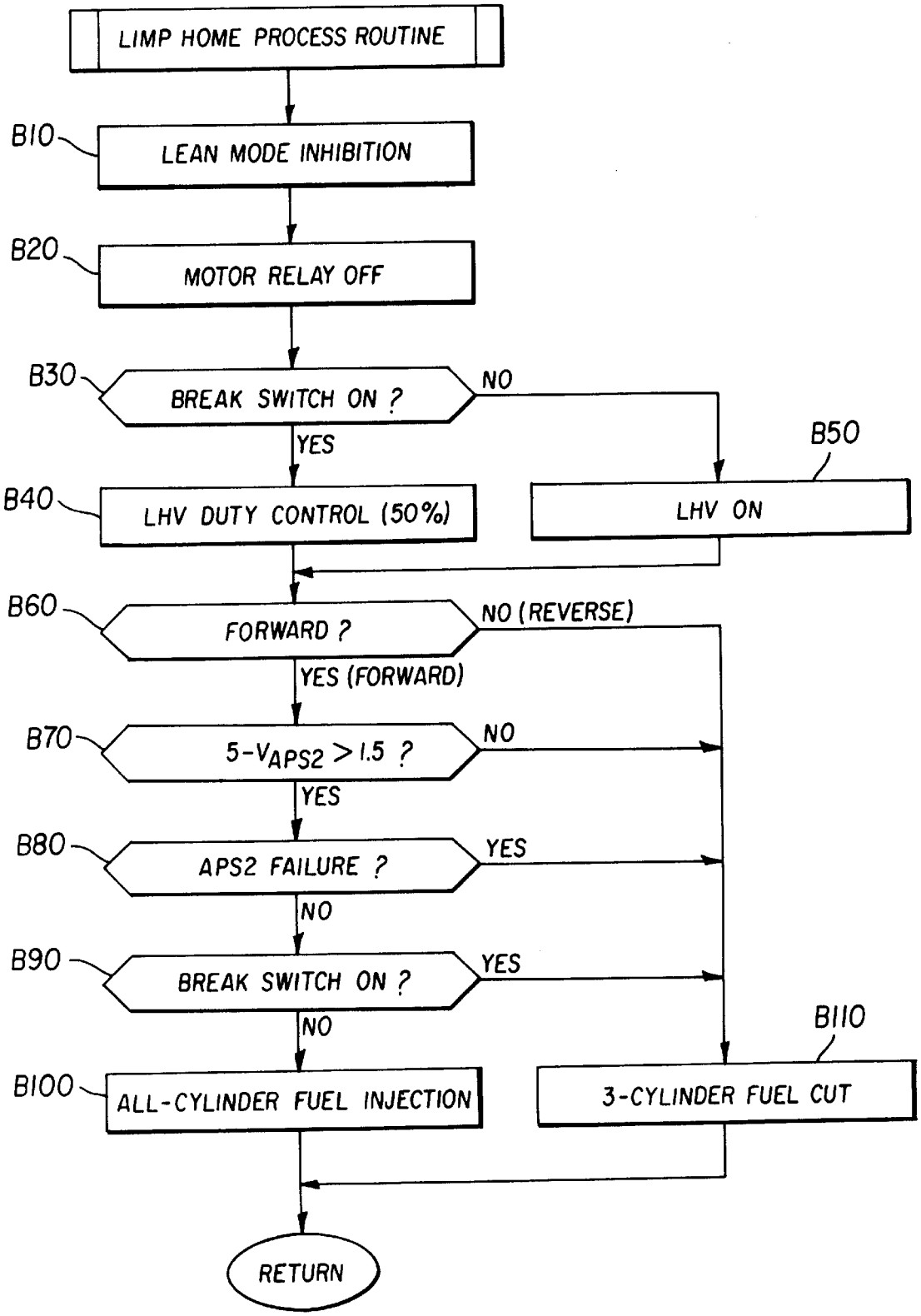
FIG. 5 is a flow chart showing an air bypass operation as one of the fail-safe operations of the intake control system of the control apparatus of the engine equipped with the electronic throttle control device according to the embodiment of FIG. 1.

FIG. 5 shows a routine of the air bypass operation performed in step A300.

Initially, the lean-burn mode is inhibited in step B10. Namely, the lean-burn mode that requires highly accurate throttle control is avoided, so as to achieve stable combustion by establishing a stoichiometric combustion mode or other mode.

In the next step B20, the motor relay (power supply relay) 62 is turned off. As a result, no power is supplied to the throttle controller 160, and the throttle valve 15 is no longer controlled by means of the throttle controller 160. Thus, only the air bypass valve 14 is controlled so as to adjust the amount of intake air.

In step B30, it is determined whether the brake switch is ON or not, namely, whether a brake is being applied or not. If the brake switch is ON, step B40 is executed to control the air bypass valve 14 at a certain duty cycle for a predetermined period of time (for example, 2 seconds).

Although the air bypass valve 14 is an ON/OFF valve that is normally placed in an ON or OFF position, this valve 14, which is a solenoid-controlled valve, may also be controlled at a given duty cycle. In this embodiment, the opening of the air bypass valve 14 is limited by setting the duty cycle to about 50%, to reduce the amount of air flowing into the bypass passage 13, thereby to increase the negative pressure of the intake manifold 9 to assure a sufficient Master vac pressure. Accordingly, a sufficiently large Master vac pressure can be obtained when brakes are applied even during the air bypass operation, thus assuring substantially the same braking force as provided in the normal operations.

The operation of step B40 suffices if it lasts a predetermined time (2 seconds in this embodiment) after start of braking, and the duty control is finished upon a lapse of the predetermined time. By limiting the duty control of the air bypass valve 14 to within the predetermined time, the solenoid of the valve 14 exhibits high durability.

If the brake switch is OFF, step B50 is then executed to place the air bypass valve 14 in the ON state.

After executing step B40 or B50, the control flow goes to step B60 to determine whether the vehicle is moving forward or not.

If the vehicle is not moving forward, namely, if the vehicle is moving backward, the fuel cut is always conducted with respect to part of the cylinders (for example, three cylinders out of six cylinders), so as to restrict the engine output (step B110). Thus, the engine output is prevented from being excessively large when the vehicle is moving backward when it is parked or put into a garage.

If the vehicle is running forward, on the other hand, the control flow goes to step B70 to determine whether the output value of the second accelerator position sensor (APS2) 51B is equal to or greater than a predetermined value ($(5v-V_{APS2})>1.5v$ or $(5v-V_{APS2})\leqq 1.5v$)).

If $(5v-V_{APS2})$ is equal to or smaller than 1.5v, step B110 is then executed to cut or stop fuel supply to part of the cylinders (for example, three cylinders out of six cylinders), so as to restrict the engine output. If $(5v-V_{APS2})$ is greater than 1.5v, step B80 is executed to determine whether the second accelerator position sensor (APS2) 51B is at fault or not. The diagnosis of this failure is conducted in the manner as described above.

If the second accelerator position sensor (APS2) 51B is at fault, step B110 is executed to cut or stop fuel supply to part of the cylinders (for example, three cylinders out of six cylinders), so as to restrict the engine output. If the second accelerator position sensor (APS2) 51B is not at fault, step B90 is executed to determine whether the brake switch is ON or not, namely, whether a brake is being applied or not.

If the brake switch is ON, step B110 is executed to stop the fuel supply to part of the cylinders (for example, three cylinders out of six cylinders), so as to restrict the engine output. If the brake switch is not ON, step B100 is then executed to inject the fuel into all of the cylinders, to ensure a sufficiently large output of the engine.

During the air bypass operation, an alarm lamp 180 is turned on.

In the air bypass operation as described above, the fuel cut is not performed when the amount of depression of the accelerator pedal is equal to or greater than a predetermined value, while no failure of the second accelerator position sensor (APS2) 51B is detected (namely, the vehicle speed demanded by the driver can be derived from the information from the sensor APS2), and no brake is applied. In the case where the vehicle is moving backward, or where the second accelerator position sensor (APS2) 51B is at fault, or where the amount of depression of the accelerator pedal is smaller than the predetermined value (namely, the driver does not demand an increase in the engine output), the fuel cut is performed with respect to part of cylinders (for example, three cylinders out of six cylinders) as a safety measure, so as to restrict the engine output.

Even in the case where the throttle valve 15 (or DBW) is at fault, the fuel cut operation can be selectively conducted depending upon the accelerator position, if the accelerator position sensor is able to correctly detect the accelerator position (or the amount of depression of the accelerator pedal). Namely, when the amount of depression of the accelerator pedal is relatively small, which means that the driver does not demand an increase in the engine torque (engine output), the fuel injection into part of cylinders (three cylinders out of six cylinders in this embodiment) is stopped (fuel cut), regardless of the current operating region of the vehicle, thereby to reduce the engine output. If the amount of depression of the accelerator pedal is relatively large, which means that the driver demands an increase in the engine torque (engine output), the fuel cut is not conducted, namely, the fuel is injected into all of the cylinders, so as to assure a sufficiently large engine output.

Thus, if the accelerator position (amount of depression of the accelerator pedal) can be detected even during a failure of the throttle valve (or DBW), the driver is able to increase the engine output and thus accelerate the vehicle, by increasing the amount of depression of the accelerator pedal (or the angle of the accelerator pedal relative to its fully released position). If the amount of depression of the accelerator pedal is reduced, the engine output can be reduced, thereby to maintain or reduce the vehicle speed. The vehicle can also be decelerated or stopped when a brake is applied, and the vehicle speed can be suitably controlled to reflect the driver s intention even where the intake system is at fault.

Even in the case where the accelerator position (or the amount of depression of the accelerator pedal) cannot be detected, the driver is able to obtain a desired vehicle speed if he/she does not apply a brake. If a brake is applied, the vehicle can be decelerated or stopped. Further, during a failure of the intake system, the vehicle speed can still be controlled to a certain degree so as to reflect the driver s intention, based on the information on braking that is a remaining means for determining the driver s intention.

While the control apparatus of the present embodiment stops fuel supply to part of the cylinders (fuel cut) so as to reduce the engine output, the amount of the fuel supplied to the cylinders may be reduced, instead of cutting the fuel, provided the combustion of the resulting mixture is possible.

In the control apparatus of the present embodiment, the means for reducing the engine output is adapted to select the compression stroke injection mode (first lean-burn mode) as one of lean-burn modes. In an engine having only a suction stroke injection mode (second lean-burn mode) as a lean-burn mode, however, the engine output may be reduced by selecting this suction stroke injection mode.

However, variations in the combustion state are likely to occur in the second lean-burn mode, and it is therefore preferable to reduce the engine output by selecting the first lean-burn mode (compression stroke injection mode) if possible.

There will be now briefly described reset conditions in diagnosing failures. The reset conditions may include 1) the OFF position of the ignition key, 2) the OFF state of the battery, and so on. The above-described control (diagnosis of failures) is repeated when the vehicle starts running again, and if the control device determines that the DBW operates normally, it is controlled in a normal fashion. If the content of failures can be stored as failure information in a computer (ECU or controller), the DBW system can be re-checked during inspection of the vehicle.

While the control apparatus of the present embodiment has been explained above as a control apparatus to be installed in an in-cylinder internal combustion engine, the control apparatus of the present invention is not limitedly used in this type of engine, but may be employed in other type of engine which is able to select a lean-burn combustion mode, and other mode (for example, stoichiometric combustion mode).

While the automatic transmission is used with the control device of the present embodiment, the present invention may be applied to a control apparatus that is used with other type of transmission system, such as a manually shifted transmission.

While the bypass passage 13 is provided for ensuring a desired amount of intake air in the event of a failure in the illustrated embodiment, a second actuator for driving the throttle valve may be provided in place of the bypass passage 13.

What is claimed is:

1. A control apparatus of an internal combustion engine equipped with an electronic control device that electrically drives a throttle valve disposed in an intake passage by means of an actuator, comprising;

failure detecting means for detecting a failure of said electronic control device to properly drive said throttle valve; and control means for adjusting a function of the engine to provide optimal engine operation based on the type of failure detected by the failure detecting means, wherein, when the failure detected by the detecting means is indicative of a stuck open throttle valve, the control means performs at least one of limiting a fuel injection system of the engine to a lean burn mode, stopping the fuel supply to at least one cylinder of the engine, turning an exhaust gas recirculation valve off, and stopping selected engine drive accessories;

wherein, when the failure detected by the detecting means is indicative of an open throttle valve and an engine speed in excess a predetermined maximum engine speed, the control means stops all fuel supply to the engine; and wherein, when the failure detected by the detecting means is indicative of a stuck closed throttle valve, the control means inhibits the fuel injection system of the engine to the lean burn mode.

2. A control apparatus of an internal combustion engine as defined in claim 1, wherein said electronic control device controls said actuator so that an opening of said throttle valve becomes equal to a target opening that is determined based on at least an amount of depression of an accelerator pedal, and wherein said failure detecting means diagnoses a failure of said electronic control device when the opening of the throttle valve is different from said target opening.

3. A control apparatus of an internal combustion engine as defined in claim 1, wherein said electronic control device includes first and second accelerator position sensors that detect the amount of depression of the accelerator pedal; and wherein said failure detecting means diagnoses a failure of said electronic control device when a first output of the first accelerator position sensor is different from a second output of the second accelerator position sensor.

4. A control apparatus of an internal combustion engine as defined in claim 1, wherein said electronic control device includes first and second throttle position sensors that detect the opening of the throttle valve; and wherein said failure detecting means diagnoses a failure of said electronic control device when a first output of the first throttle position sensor is different from a second output of the second throttle position sensor.

5. A control apparatus of an internal combustion engine according to claim 1, wherein, when the failure detected by the failure detecting means is indicative of a stuck open throttle valve, the control means closes an air bypass valve, and wherein, when the failure detected by the failure detecting means is indicative of a stuck closed throttle valve, the control means opens an air bypass valve.

6. A control apparatus of an internal combustion engine equipped with an electronic control device that electrically drives a throttle valve disposed in an intake passage by means of an actuator, comprising:

combustion mode control device which selects a combustion mode from a normal combustion mode in which an air fuel mixture formed in a combustion chamber has a first air-fuel ratio, and a lean-burn mode in which the air fuel mixture formed in the combustion chamber has a second air-fuel ratio that is larger than said first air-fuel ratio, depending upon an operating state of the engine; and failure detecting means for detecting a failure of said electronic control device;

wherein said combustion mode control device selects the lean-burn mode regardless of the operating state of the engine, when said failure detecting means determines that said throttle valve is stuck at a position in which an opening of the throttle valve is equal to or larger than a first predetermined value.

7. A control apparatus of an internal combustion engine as defined in claim 6, wherein said combustion mode control device establishes a selected one of the normal mode in which a fuel is supplied to an entire space of the combustion chamber so that the air-fuel mixture is uniformly burned, and the lean-burn mode in which the fuel is supplied to a vicinity of a spark plug in the combustion chamber so that the air-fuel mixture undergoes stratified charge combustion.

8. A control apparatus of an internal combustion engine equipped with an electronic control device that electrically drive a throttle valve disposed in an intake passage by means of an actuator, comprising:

a combustion mode control device that selects a combustion mode from a normal combustion mode in which an air-fuel mixture formed in a combustion chamber has a first air fuel ratio, and a lean-burn mode in which the air-fuel mixture in the combustion chamber has a second air fuel ratio that is larger than said first air fuel ratio, depending upon an operating state of the engine; and failure detecting means for detecting a failure of the electronic control device, wherein said combustion mode control device inhibits the lean-burn mode regardless of the operating state of the engine, when said failure detecting means determines that said throttle valve is stuck at a position in which an opening of the throttle valve is equal to or smaller than a second predetermined value.

9. A control apparatus of an internal combustion engine as defined in claim 8, wherein said combustion mode control device establishes a selected one of the normal mode in which a fuel is supplied to an entire space of the combustion chamber so that an air-fuel mixture is uniformly burned, and the lean-burn mode in which the fuel is supplied to a vicinity of a spark plug in the combustion chamber so that the air-fuel mixture undergoes startified charge combustion.

10. A control apparatus of an internal combustion engine equipped with an electronic control device that sets a target throttle opening based on at least an operated state of an accelerator operating device, and electrically drives a throttle valve disposed in an intake passage by means of an actuator, so that the throttle valve reaches the target throttle opening, comprising:

failure detecting means for detecting a failure of the electronic control device;

intake air supply means for supplying a predetermined amount of intake air to the engine, wherein said control apparatus actuates intake air supply means when a failure detected by said failure detecting means is other than a failure detected when the throttle valve is stuck at a position in which an opening of the throttle valve is equal to or larger than a first predetermined value.

11. A control apparatus of an internal combustion engine as defined in claim 10, further comprising:

driver s demand detecting means for detecting a driver s demand for an output of the engine;

wherein said control apparatus limits fuel supply to the engine during an operation of said intake air supply means when said driver s demand detecting means does not detect the driver s demand for the output of the engine, and stops limiting the fuel supply when the driver s demand detecting means detects the driver s demand for the output of the engine.

12. A control apparatus of an internal combustion engine as defined in claim 11, wherein said driver s demand detecting means comprises means for detecting whether a brake pedal is depressed or not.

13. A control apparatus of an internal combustion engine as defined in claim 11, wherein said driver s demand detecting means comprises means for detecting whether an accelerator pedal is depressed or not.

14. A control apparatus of an internal combustion engine as defined in claim 11, wherein said driver s demand detecting means comprises means for detecting a shift position of a transmission.

15. A control apparatus of an internal combustion engine as defined in claim 10, wherein said intake air supply means comprises a bypass passage that communicates with said intake passage at an upstream side and a downstream side of said throttle valve, and a bypass valve disposed in said bypass passage.

16. A control apparatus of an internal combustion engine as defined in claim 10, wherein said intake air supply means comprises drive means, as a separate member from said actuator, for forcing displacement of said throttle valve so that the throttle valve reaches a third predetermined opening.

17. A control apparatus of an internal combustion engine as defined in claim 16, wherein said drive means comprises a spring that biases said throttle valve so that the throttle valve reaches said third predetermined opening.

18. A control apparatus of an internal combustion engine as defined in claim 16, wherein said drive means comprises a second actuator that drives said throttle valve so that the throttle valve reaches said third predetermined opening.

19. A control apparatus of an internal combustion engine equipped with an electronic control device that electrically drives a throttle valve disposed in an intake passage by means of an actuator, comprising:

an intake air device which includes a bypass passage that bypasses the throttle valve, and a control valve provided in the bypass passage, said control valve being opened so as to provide a given amount of intake air, irrespective of a state of the throttle valve;

a combustion mode control device that selects a combustion mode from a normal combustion mode in which an air-fuel mixture formed in a combustion chamber has a first air fuel ratio, and a lean-burn mode in which the air-fuel mixture formed in the combustion chamber has a second air fuel ratio that is larger than said first air fuel ratio, depending upon an operating state of the engine; and failure detecting means for detecting a failure of the electronic control device, wherein said combustion mode control device selects the lean-burn mode regardless of the operating state of the engine, when a failure of said control valve is detected by said failure detecting means.

20. A control apparatus of an internal combustion engine according to claim 19, wherein said combustion mode control device establishes a selected one of the normal mode in which a fuel is supplied to an entire space of the combustion chamber so that an air-fuel mixture is uniformly burned, and the lean-burn mode in which the fuel is supplied to a vicinity of a spark plug in the combustion chamber so that the air-fuel mixture undergoes startified charge combustion.

21. A control apparatus of an internal combustion engine equipped with an electronic control device that electrically drives a throttle valve disposed in an intake passage by means of an actuator, comprising:

a failure detecting device that detects a failure of the electronic control device;

a bypass control device which includes a bypass passage that bypasses the throttle valve, and a control valve provided in said bypass passage, said control valve being opened so as to provide a given amount of intake air when a failure of the electronic control device is detected by said failure detecting device; and driver s demand detecting means for detecting a driver s demand for an output of the engine;

fuel supply means for controlling fuel supply to a plurality of cylinders of the engine, wherein said fuel supply means stops fuel supply to at least one of said plurality of cylinders, when said failure detecting device detects a failure of the electronic control device and said output demand detecting means does not detect the driver s demand for the output of the engine.

22. A control apparatus of an internal combustion engine as defined in claim 21, wherein said driver s demand detecting means comprises means for detecting whether a brake pedal is depressed or not.

23. A control apparatus of an internal combustion engine as defined in claim 21, wherein said driver s demand detecting means comprises means for detecting whether an accelerator pedal is depressed or not.

24. A control apparatus of an internal combustion engine as defined in claim 21, wherein said driver s demand detecting means comprises means for detecting a shift position of a transmission.

25. A control apparatus of an internal combustion engine equipped with an electronic control device that electrically drives a throttle valve disposed in an intake passage by means of an actuator, comprising:

a failure detecting device which detects a failure of the electronic control device;

a bypass control device that includes a bypass passage that bypasses a throttle valve, and a control valve disposed in said bypass passage, said bypass control device opening the control valve so as to provide a given amount of intake air when said failure detecting device detects a failure of the electronic control device; and brake detecting means for detecting an operated state of a brake pedal, wherein said bypass control device controls said control valve so as to limit an amount of intake air flowing through said bypass passage when said failure detecting device detects a failure of the electronic control device, and said brake detecting means determines that the brake pedal is depressed.

26. A control apparatus of an internal combustion engine as defined in claim 25, wherein said bypass control device limits the amount of intake air flowing through said bypass passage by controlling a duty cycle of said control valve.

* * * * *